US010639530B2

(12) United States Patent
Zavracky

(10) Patent No.: US 10,639,530 B2
(45) Date of Patent: May 5, 2020

(54) WATER BALL HOOP

(71) Applicant: Flambeau, Inc., Baraboo, WI (US)

(72) Inventor: Richard Zavracky, Aurora, OH (US)

(73) Assignee: Flambeau, Inc., Baraboo, WI (US)

( * ) Notice: Subject to any disclaimer, the term of this patent is extended or adjusted under 35 U.S.C. 154(b) by 0 days.

(21) Appl. No.: 15/633,205

(22) Filed: Jun. 26, 2017

(65) Prior Publication Data

US 2018/0001171 A1 Jan. 4, 2018

Related U.S. Application Data

(60) Provisional application No. 62/357,109, filed on Jun. 30, 2016.

(51) Int. Cl.

| | |
|---|---|
| ***A63B 63/00*** | (2006.01) |
| ***A63B 67/00*** | (2006.01) |
| ***A63B 63/06*** | (2006.01) |
| *A63B 67/06* | (2006.01) |

(52) U.S. Cl.

CPC ..... *A63B 67/007* (2013.01); *A63B 63/007* (2013.01); *A63B 63/06* (2013.01); *A63B 63/00* (2013.01); *A63B 67/06* (2013.01); *A63B 2225/605* (2013.01)

(58) Field of Classification Search

CPC . A63B 2225/605; A63B 63/00; A63B 67/007; A63B 67/06

USPC ..... 273/350, 398–402

See application file for complete search history.

(56) References Cited

U.S. PATENT DOCUMENTS

| | | | | | |
|---|---|---|---|---|---|
| 3,430,958 | A * | 3/1969 | Lakeman | A63B 63/08 | 273/400 |
| 3,778,060 | A * | 12/1973 | Lakeman | A63B 63/00 | 273/342 |
| 3,895,801 | A * | 7/1975 | Baird | A63B 63/00 | 273/350 |
| 3,989,250 | A * | 11/1976 | Lakeman | A63B 63/00 | 273/350 |
| 4,828,270 | A * | 5/1989 | Chiang | A63B 63/00 | 273/401 |
| 5,217,230 | A * | 6/1993 | Judd | A63B 63/00 | 273/398 |
| 5,632,490 | A * | 5/1997 | Brown | A63F 7/048 | 273/138.3 |
| 6,030,300 | A * | 2/2000 | Zheng | A63B 9/00 | 135/125 |
| 6,173,957 | B1 * | 1/2001 | James, Sr. | A63B 63/08 | 273/350 |
| 7,210,685 | B2 * | 5/2007 | Cheng | A63B 43/005 | 273/348.4 |
| 7,360,767 | B2 * | 4/2008 | Merccica | A63B 67/06 | 273/350 |
| 9,821,241 | B2 * | 11/2017 | Haner | A63H 33/08 | |

(Continued)

*Primary Examiner* — Mark S Graham

(74) *Attorney, Agent, or Firm* — Quarles & Brady LLP

(57) ABSTRACT

A goal configured to both float and be used on water is disclosed. The goal comprises a base, a support structure, and a planar element. The base includes a top surface defining a base plane. The support structure has a pair of opposing arm portions coupled to the base. The planar element is coupled to and extends between the pair of opposing arms of the support structure, is disposed generally perpendicular to the base plane, and defines at least one generally circular main aperture.

17 Claims, 9 Drawing Sheets

(56) References Cited

U.S. PATENT DOCUMENTS

| | | | | |
|---|---|---|---|---|
| 2004/0102260 | A1* | 5/2004 | Chia | A63B 63/083 473/472 |
| 2004/0221885 | A1* | 11/2004 | Zheng | A63B 9/00 135/126 |
| 2008/0258393 | A1* | 10/2008 | Lowrance | A63F 9/305 273/393 |
| 2014/0054858 | A1* | 2/2014 | Boyer | A63B 63/00 273/350 |
| 2016/0121186 | A1* | 5/2016 | Sciandra | A63B 67/06 273/350 |

* cited by examiner

WATER BALL HOOP

CROSS-REFERENCE TO RELATED APPLICATIONS

This application claims the benefit of U.S. Provisional Application 62/357,109 filed Jun. 30, 2016, which is incorporated herein by reference for all purposes.

STATEMENT REGARDING FEDERALLY SPONSORED RESEARCH

N/A

BACKGROUND OF THE INVENTION

The field of the invention relates to an inflatable goal or target. More particularly, the invention relates to an inflatable goal or target that allows the user to throw, kick, skip or otherwise propel an object, such as a ball, through the goal or target and may be used in a pool or other body of water.

There are many land-based games which involve throwing objects at targets or hoops as a game of skill. Land based games such as basketball, volleyball and football have been adapted to play while the participants are in or near the water. There are no water-based games which combine and test these skills. It has been popular, for many years, to play ball games in conjunction with swimming pools. In many areas, bodies of water, such as swimming pools, provide no other recreational activity other than swimming. Using games of skill for fun and enjoyment in a pool provides additional activities other than swimming. It has been known to construct goals for mounting in conjunction with the edge of a swimming pool, or just outside the pool on the ground or the pool deck. There exist games adapted to be played in a pool such as basketball. Basketball, like many other land sports, tend to be quite difficult when played in a pool, especially when two teams are opposing one another. A typical goal may include a basketball hoop, wherein the basketball hoop and net are elevated some distance above the surface of the water, and scoring requires that a participant throw the ball in an arc with it being intended that it is to pass through the hoop and the net.

SUMMARY OF THE INVENTION

The present invention overcomes the aforementioned drawbacks by providing a water-based game that is inflatable and portable and can be played individually or as a team or group, and does not require contact between two different players. For the purposes of this disclosure the terms "goal" and "target" may be used interchangeably throughout the disclosure.

This disclosure describes a goal configured to both float and be used on water. The goal comprises a base, a support structure, and a planar element. The base includes a top surface defining a base plane. The support structure has a pair of opposing arm portions coupled to the base. The planar element is coupled to and extends between the pair of opposing arms of the support structure, is disposed generally perpendicular to the base plane, and defines at least one main aperture.

In an embodiment, the support structure may be an inverted U-shaped member further including a curved upper portion coupled to, extending between, and in fluid communication with the pair of opposed arm portions. Each of the base and the inverted U-shaped member may be inflatable, and the base and the inverted U-shaped member may be in fluid communication, such that inflation of one of the base and the inverted U-shaped member results in the inflation of the other of the base and the inverted U-shaped member. A lower surface of the base may be adapted to float on a surface of the water. The planar element may be disposed at an angle other than truly perpendicular to the base plane. The goal may further comprise at least one inflation valve.

In an embodiment, the base may be generally rectangular in shape, and the support structure may be disposed such that the planar element is arranged transverse to a longitudinal axis of the base. The support structure may be disposed equidistant from a first longitudinal end and a second longitudinal end of the base. The goal may further comprise at least one tether attachment tab defining a tether aperture, wherein an edge of the tether attachment tab is attached to the base. The edge of the tether attachment tab may be attached to at least one of a latitudinal side and a longitudinal end of the base. The base may comprise at least two tubular members, each disposed parallel to the longitudinal axis of the base. The at least two tubular members may be in fluid communication with one another. The at least two tubular members may have rounded ends.

In an embodiment, at least a portion of the planar element is in direct contact with the base. The support structure may not be in fluid communication with the base. The planar element may define a plurality of attachment apertures disposed around a circumference of the at least one main aperture. A net or similar structure may be attached to the planar element via at least 4 of the plurality of attachment apertures. The net may define a substantially cylindrical shape having a pair of open ends and the net may be attached to the planar element via one of the pair of open ends. Alternatively, the net may define a substantially cylindrical shape having an open end and a closed end and the net may be attached to the planar element via the open end. The support structure may comprise a substantially straight upper portion coupled to, extending between, and in fluid communication with the pair of opposed arm portions in lieu of, or in combination with, the upper curved portion.

The foregoing and other aspects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims and herein for interpreting the scope of the invention.

DETAILED DESCRIPTION OF THE INVENTION

Figure 1:
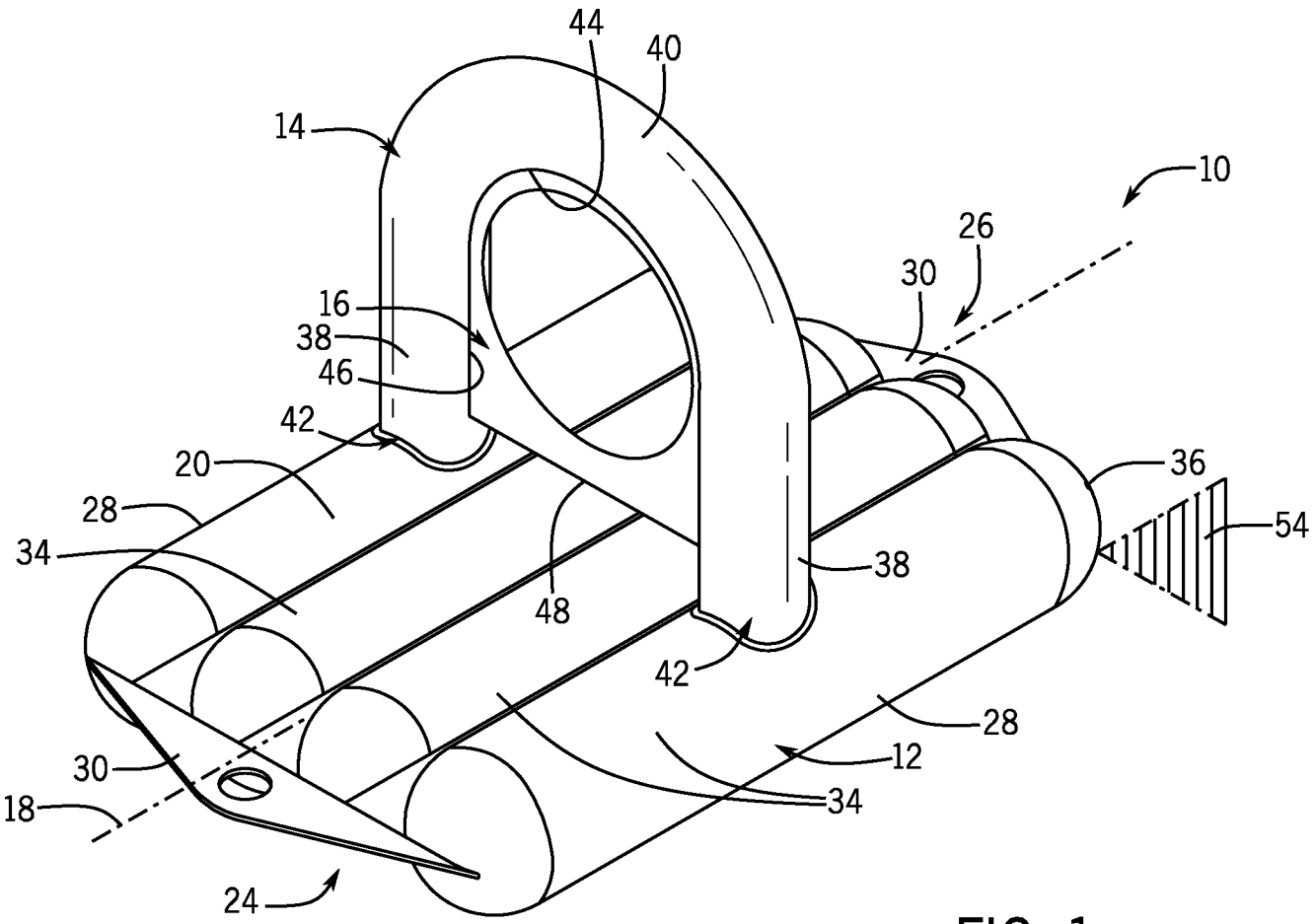
FIG. 1 is a front, top, right isometric view of an exemplary goal in accordance with the present invention.
Figure 2:
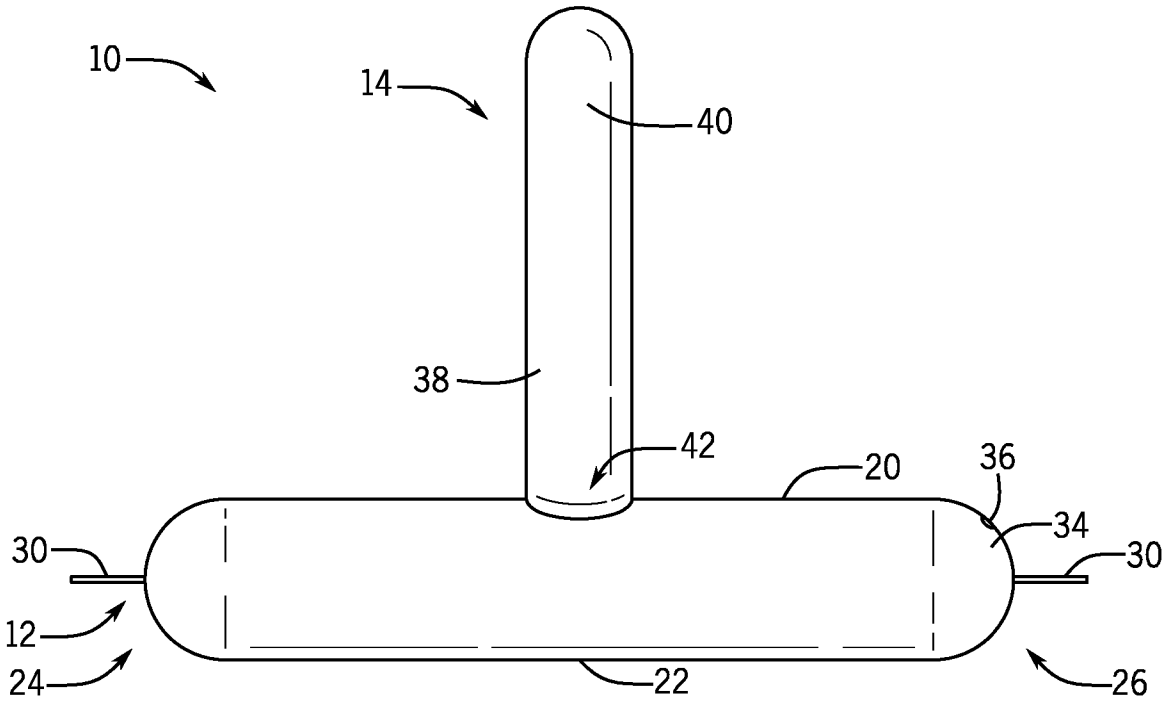
FIG. 2 is a side elevation view of the goal of FIG. 1.
Figure 3:
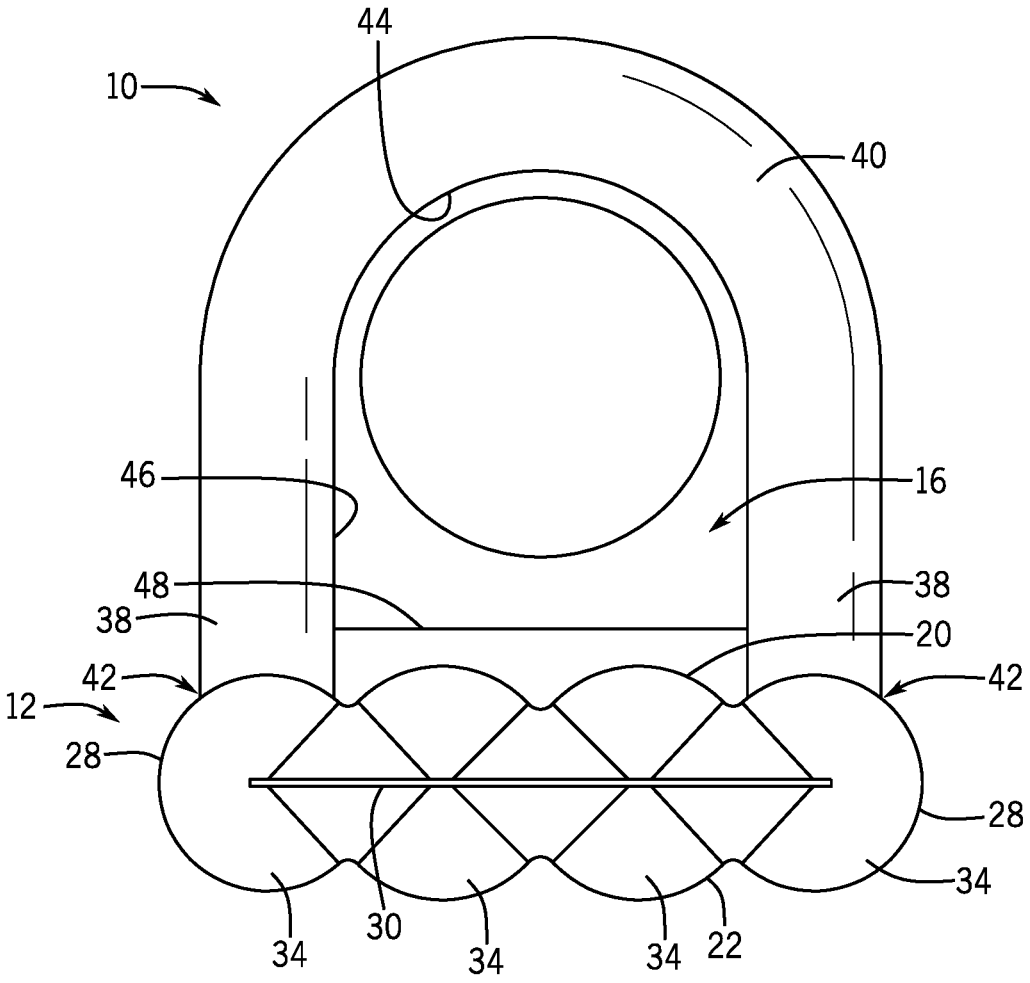
FIG. 3 is a front elevation view of the goal of FIG. 1.
Figure 4:
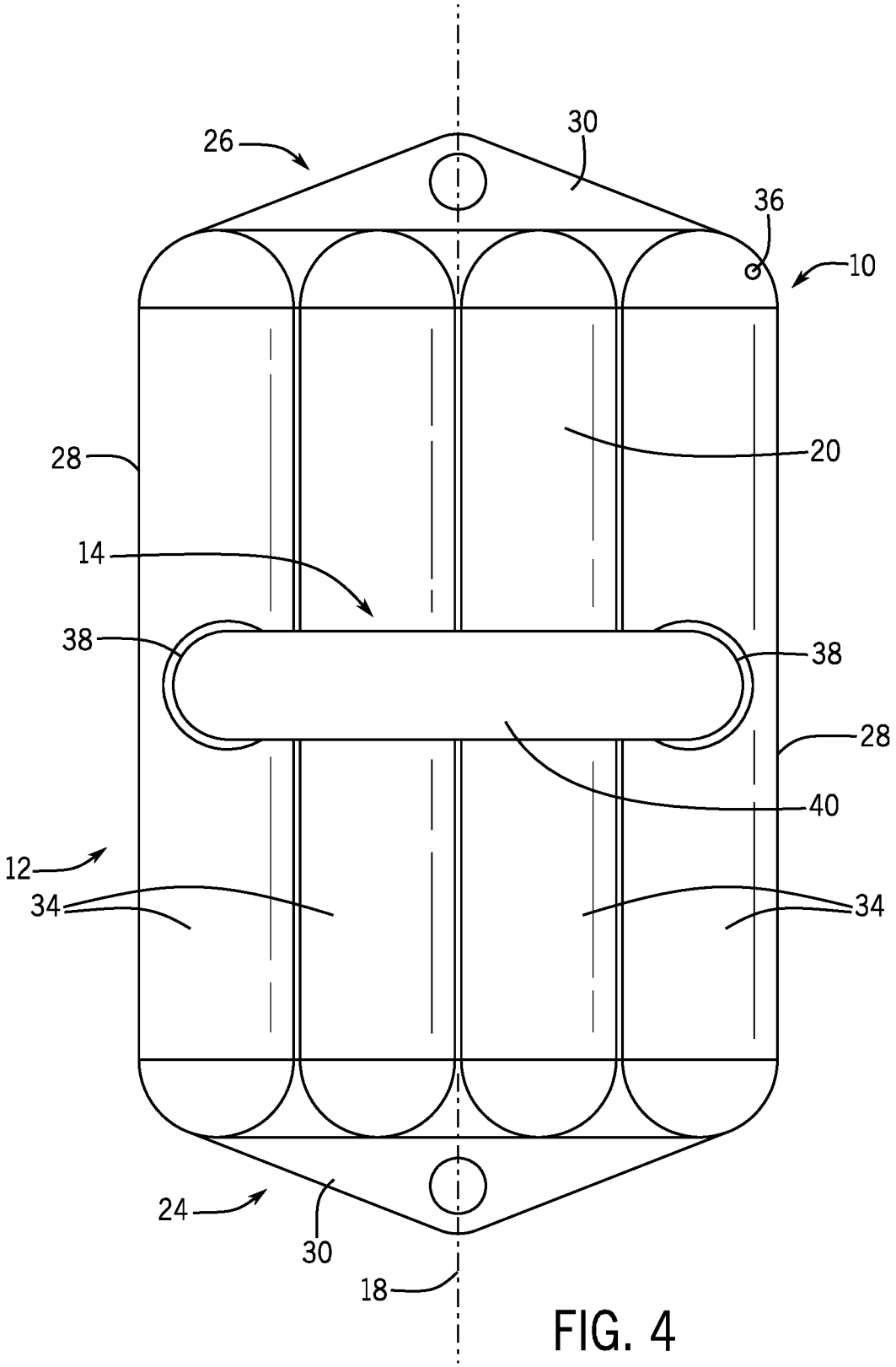
FIG. 4 is a top plan view of the goal of FIG. 1.

Referring to FIGS. 1-4, exemplary goal 10 is provided in accordance with the present disclosure. As described below, goal 10 is configured to both float and be used in water. Goal 10 comprises base 12, inverted U-shaped member 14, and planar element 16. Base 12 is inflatable and is in fluid communication with inverted U-shaped member 14, such that inflation of one of base 12 and inverted U-shaped member 14 results in the inflation of the other of base 12 and inverted U-shaped member 14.

Base 12 additionally defines a substantially rectangular shape having longitudinal axis 18 and includes upper surface 20, lower surface 22, first longitudinal end 24, second longitudinal end 26, and pair of latitudinal sides 28. Upper surface 20 is coupled to inverted U-shaped member 14, as is described below. Lower surface 22 is adapted to float on a surface of the water. Each of first longitudinal end 24 and second longitudinal end 26 includes tether attachment tab 30 extending longitudinally away from corresponding longitudinal end 24, 26. Each tether attachment tab 30 defines a tether aperture. Further, although the illustrated tether attachment tabs 30 are coupled to first and second longitudinal ends 24, 26, in some instances, tether attachment tabs 30 may additionally or alternatively be coupled to either or both of pair of latitudinal sides 28.

Base 12 is further formed by a plurality of tubular members 34, each of which are inflatable, have substantially rounded ends, and are disposed parallel to longitudinal axis 18 of base 12. Base 12 further includes inflation valve 36 on one of the plurality of tubular members 34. As illustrated, each tubular member 34 is in fluid communication with each of the other tubular members 34, such that when one tubular member 34 is inflated, using inflation valve 36, it results in the inflation of each of the other tubular members 34. In some instances, the plurality of tubular members 34 may not be in fluid communication with each other. In these instances, in order to inflate each tubular member 34, each tubular member 34 may include an inflation valve similar to inflation valve 36.

U-shaped member 14 is inflatable and forms a support structure for planar element 16, as is described below. U-shaped member 14 includes a pair of opposed arm portions 38 coupled to and in fluid communication with curved upper portion 40. The pair of opposed arm portions 38 are disposed generally parallel to one another and are each coupled at lower end 42 to upper surface 20 of base 12. Each of the pair of opposed arm portions 38 is further in fluid communication with base 12. As such, when base 12 is inflated, using inflation valve 36, it results in the inflation of the pair of opposed arm portions 38, as well as curved upper portion 40, resulting in the inflation of the entire U-shaped member 14. Curved upper portion 40 is coupled to, extends between, and is in fluid communication with the pair of opposed arm portions 38. Curved upper portion 40 further defines an arcuate shape, with concave side 44 of curved upper portion 40 facing base 12, thereby forming the U-shape of U-shaped member 14.

As illustrated, inverted U-shaped member 14 is disposed substantially equidistant from first and second longitudinal ends 24, 26. In some instances, inverted U-shaped member 14 may be disposed non-equidistantly from first and second longitudinal ends 24, 26. For example, in some instances, inverted U-shaped member 14 may be disposed closer to either first longitudinal end 24 or second longitudinal end 26. Additionally, although the illustrated U-shaped member 14 is in fluid communication with base 12, in some instances, U-shaped member 14 may not be in fluid communication with base 12. In this instance, U-shaped member 14 may include an inflation valve, similar to inflation valve 36.

Planar element 16 is coupled to and extends between the pair of opposed arm portions 38 and curved upper portion 40. Planar element 16 includes first edge 46, second edge 48, and further defines a main aperture. First edge 46 is coupled to inverted U-shaped member 14 on an exterior surface of inverted U-shaped member 14. First edge 46 is further coupled on a radially-inward facing side of the exterior surface of inverted U-shaped member 14, extending from proximate lower end 42 of a first of the pair of opposed arm portions 38, around concave side 44 of curved upper portion 40, and terminating proximate to lower end 42 of a second of the pair of opposed arm portions 38. Second edge 48 extends between the pair of opposed arm portions 38 and is not in direct contact with upper surface 20, such that a small gap is defined between planar element 16 and upper surface 20 extending between the pair of opposed arm portions 38. In certain embodiments, all or a portion of second edge 48 may be in contact with upper surface 20. The illustrated main aperture is generally circular and is disposed proximate to curved upper portion 40. However, in other embodiments, the main aperture could be disposed proximate to second edge 48 or other locations generally.

As illustrated, planar element 16 is arranged generally perpendicular to base plane 54 defined by upper surface 20 of base 12, and generally transverse to longitudinal axis 18 of base 12. However, in some instances planar element 16 may be arranged at an angle that is not truly perpendicular to base plane 54 and/or that is not truly transverse to longitudinal axis 18.

Additionally, in the illustrated exemplary goal 10, the main aperture defined by planar element 16 is generally concentric with a semicircle defined by curved upper portion 40. In some instances, the main aperture may not be concentric with the semicircle defined by curved upper portion 40. Further, in the illustrated exemplary goal 10, the radius of the main aperture is slightly smaller than a radius of concave side 44 of curved upper portion 40, such that a small strip of planar element 16 is disposed between the main aperture and concave side 44 of curved upper portion 40. In some embodiments, the radius of the main aperture may be equal to the radius of concave side 44 of curved upper portion 40, such that the main aperture is formed between planar element 16 on a bottom half of the main aperture and concave side 44 of curved upper portion 40 on an upper half of the main aperture. Furthermore, illustrated exemplary goal 10 includes a single main aperture. In some instances, goal 10 may include at least one secondary aperture defined by planar element 16. The at least one secondary aperture may provide additional targets or goals to be used in conjunction with the main aperture. The size of the at least one secondary aperture may vary from that of the main aperture or any other secondary aperture.

Figure 5:
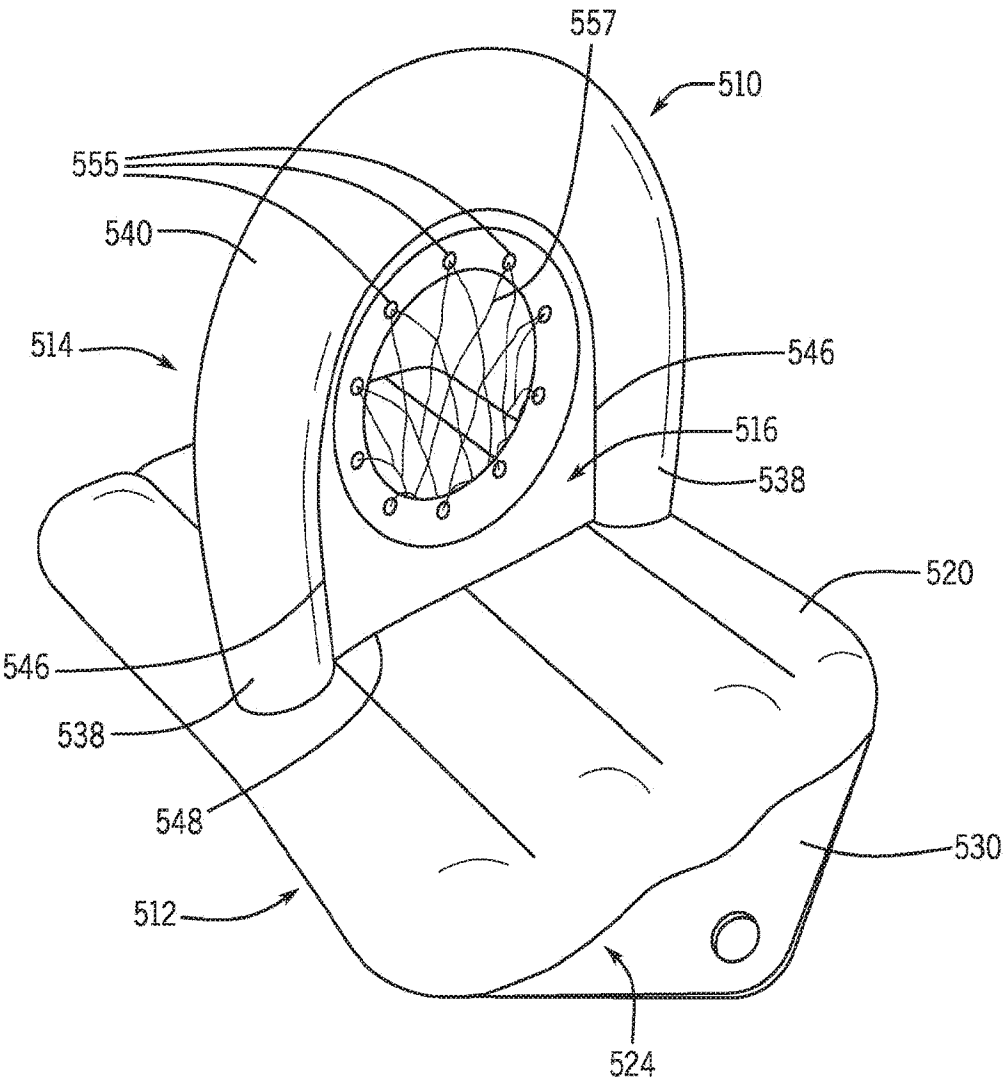
FIG. 5 is a front, top, left perspective view of another exemplary goal in accordance with the present invention.

Referring now to FIG. 5, another exemplary goal 510 is provided in accordance with the present disclosure. Goal 510 is substantially similar to goal 10, described above. As such, like elements are labeled similarly, in the 500 series (e.g., base 12 and base 512, inverted U-shaped member 14 and inverted U-shaped member 514, etc.). Various differences between goal 510 and goal 10 are described below.

Goal 510 similarly includes base 512, inverted U-shaped member 514, and planar element 516. Additionally, planar element 516 again includes first edge 546, second edge 548, and defines a main aperture. However, all or at least a portion of second edge 548 of planar element 516 is directly coupled to upper surface 520 of base 512. Further, between first edge 546 and second edge 548, planar element 516 may also define corner cutaways formed between upper surface 520 and planar element 516 (not shown).

In addition to the main aperture, planar element 516 may further define a plurality of attachment apertures. The plurality of attachment apertures are disposed generally around a circumference of the main aperture. Collectively, the plurality of attachment apertures are used to couple net 557 to planar element 516. Illustrated net 557 defines a flexible substantially cylindrical shape having a pair of open ends. Net 557 is coupled to planar element 516 by coupling one of the pair of open ends to the plurality of attachment apertures. In some instances, net 557 may alternatively include an open end, attached to the plurality of attachment apertures, and a closed end at an opposite end. As such, if an object is thrown into net 557, as will be described below, the object will be retained within net 557, until retrieved by a user.

In the illustrated exemplary goal 510, there are ten attachment apertures coupled to net 557. In some instances there can be as few as four attachment apertures coupled to net 557.

Figure 6:
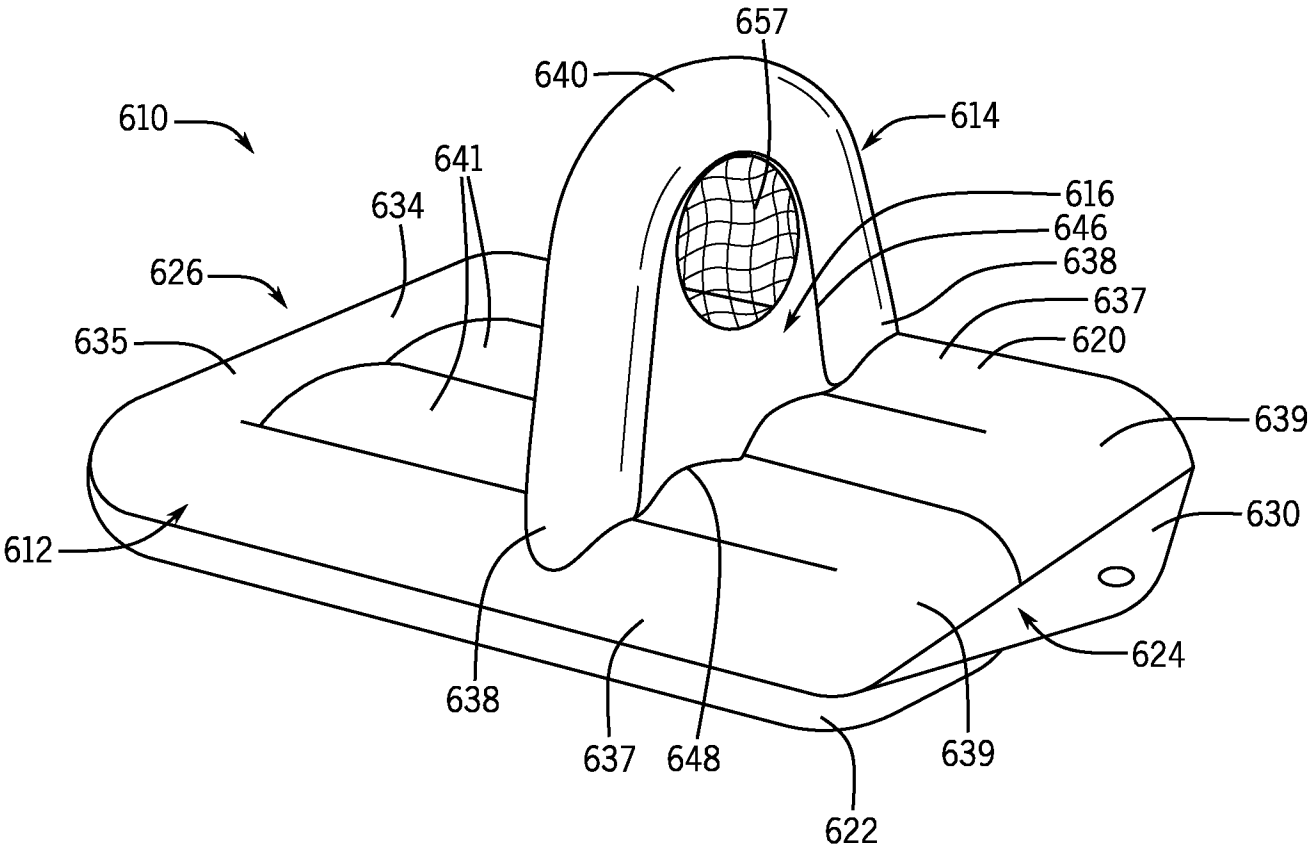
FIG. 6 is a front, top, left perspective view of another exemplary goal in accordance with the present invention.
Figure 7:
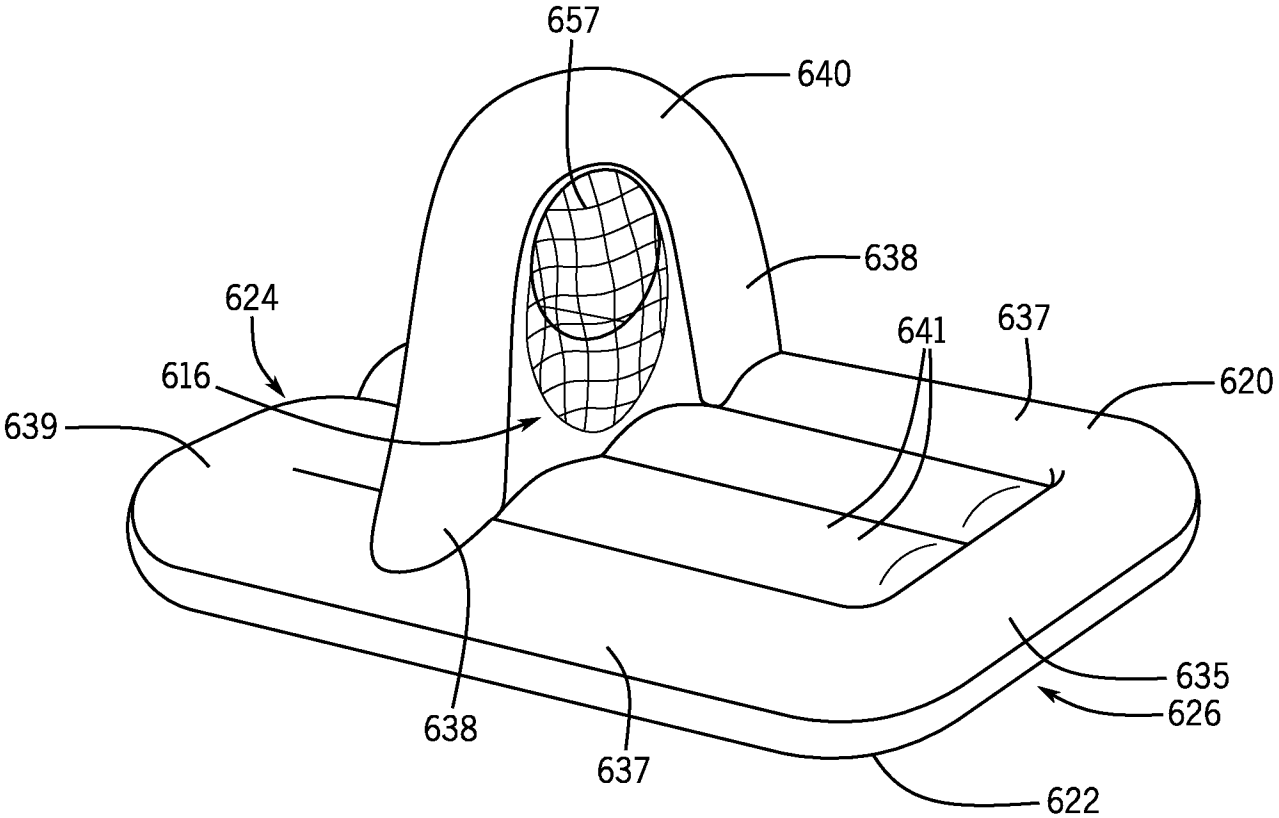
FIG. 7 is a rear, top, right perspective view of the goal of FIG. 6.

Referring now to FIGS. 6 and 7, another exemplary goal 610 is provided in accordance with the present disclosure. Goal 610 is again substantially similar to goal 10, described above. As such, like elements are labeled similarly, in the 600 series (e.g., base 12 and base 612, inverted U-shaped member 14 and inverted U-shaped member 614, etc.). Various differences between goal 610 and goal 10 are described below.

Goal 610 similarly includes base 612, inverted U-shaped member 614, and planar element 616. However, as illustrated, base 612 is alternatively made of single tubular member 634 that is shaped with various coplanar bends, turns, or angles to form base 612, as is described below.

Specifically, single tubular member 634 is inflatable and includes transverse end portion 635, a pair of outer arm portions 637, a pair of transverse bend portions 639, and at least two inner arm portions 641. Transverse end portion 635 extends transversely across base 612 at second longitudinal end 626. The pair of outer arm portions 637 are coupled to and in fluid communication with transverse end portion 635. The pair of outer arm portions 637 further extend from opposing latitudinal ends of transverse end portion 635, in a longitudinal direction, toward first longitudinal end 624. The pair of transverse bend portions 639 are each coupled to and in fluid communication with a corresponding one of the pair of outer arm portions 637. Each transverse bend portion 639 further extends from a longitudinal end of the corresponding outer arm portion 637, transversely inward, toward each other. Each inner arm portion 641 is coupled to and in fluid communication with a corresponding transverse bend portion 639. Each inner arm portion 641 further extends from an inner end of the corresponding transverse bend portion 639, in a longitudinal direction toward second longitudinal end 626, maintaining direct contact with both each other and a corresponding outer arm portion 637 and terminating at transverse end portion 635.

As illustrated, inverted U-shaped member 614 is disposed more proximate first longitudinal end 624 than second longitudinal end 626. Additionally, as illustrated, the pair of opposed arm portions 638 are attached to base 612, such that the pair of opposed arm portions 638 are angled toward each other from the end proximate to base 612 to the end distal to base 612. Furthermore, all or a portion of planar element 616 of goal 610 is directly coupled to upper surface 620 of base 612. Also, net 657 of goal 610 is coupled to planar element 616 at an open end of net 657, and the opposing end of net 657 is closed (as best shown in FIG. 7).

Figure 8:
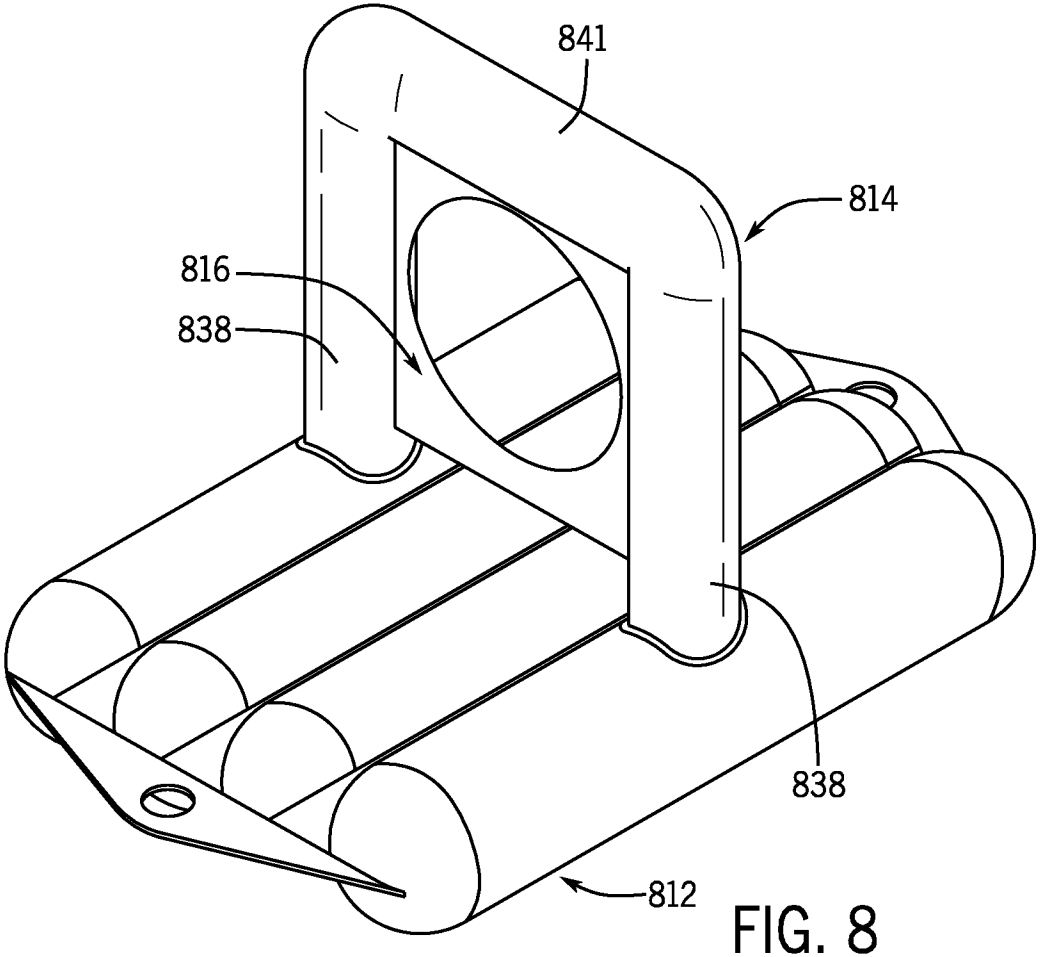
FIG. 8 is a front, top, right isometric view of another exemplary goal in accordance with the present invention.

Referring now to FIG. 8, another exemplary goal 810 is provided in accordance with the present disclosure. Goal 810 is again substantially similar to goal 10, described above. As such, like elements are labeled similarly, in the 800 series (e.g., base 12 and base 812, inverted U-shaped member 14 and inverted U-shaped member 814, etc.). Various differences between goal 810 and goal 10 are described below.

Goal 810 similarly includes base 812, inverted U-shaped member 814, and planar element 816. However, as illustrated, in lieu of the curved upper portion, U-shaped member 814 alternatively includes substantially straight upper portion 841 coupled to, extending between, and in fluid communication with the pair of opposed arm portions 838.

Figure 9:
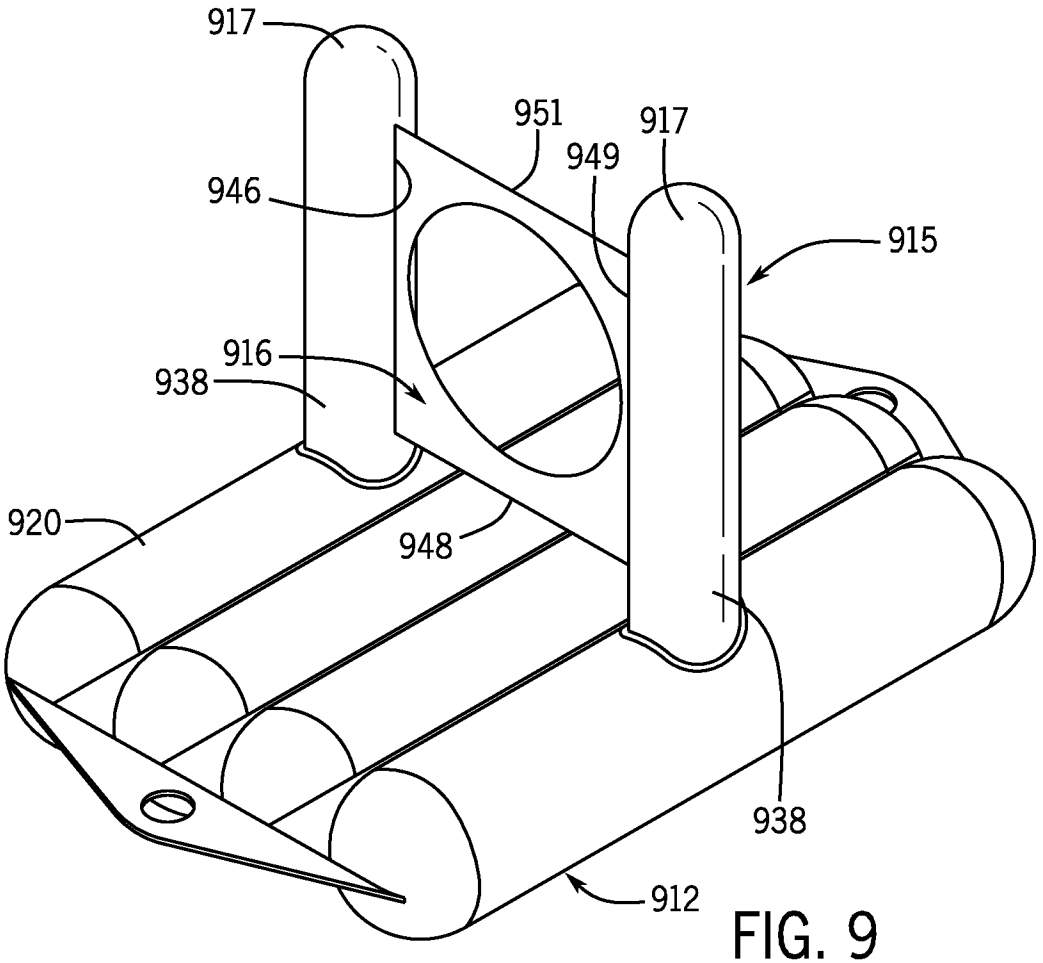
FIG. 9 is a front, top, right isometric view of another exemplary goal in accordance with the present invention.

Referring now to FIG. 9, another exemplary goal 910 is provided in accordance with the present disclosure. Goal 910 is again substantially similar to goal 10, described above. As such, like elements are labeled similarly, in the 900 series (e.g., base 12 and base 912, planar element 16 and planar element 916, etc.). Various differences between goal 910 and goal 10 are described below.

Goal 910 similarly includes base 912 and planar element 916. However, instead of goal 910 including a support structure in the form of an inverted U-shaped member, goal 910 includes support structure 915 formed solely by a pair of opposed arm portions 938, which extend upward from base 912, each terminating at end 917. Planar element 916 is then coupled to and extends between the pair of opposed arm portions 938 and includes first edge 946, second edge 948, third edge 949, and fourth edge 951. First edge 946 is coupled to a first of pair of opposed arm portions 938, extending from generally proximate to end 917 of a first of the pair of opposed arm portions 938 to proximate to upper surface 920 of base 912. Second edge 948 extends from the first of the pair of opposed arm portions 938, toward a second of the pair of opposed arm portions 938, proximate to upper surface 920 of base 912. A gap may or may not be formed between second edge 948 and upper surface 920. Third edge 949 is coupled to the second of the pair of opposed arm portions 938, extending from proximate to upper surface 920 of base 912 to generally proximate to end 917 of the second of pair of opposed arm portions 938. Fourth edge 951 extends from generally proximate to end 917 of the second of pair of opposed arm portions 938 to generally proximate to end 917 of the first of pair of opposed arm portions 938. Ends 917 may or may not be rounded.

Although goals 10, 510, 610, 810 and 910 have been provided herein as separate examples, it will be understood that various elements of any of goals 10, 510, 610, 810 and 910 can be added to or substituted for various elements of any of the other goals 10, 610, 810 and 910 and these combinations and alterations have been contemplated and are fully within the scope of the present invention.

Now that the structures of the various goals 10, 510, 610, 810 and 910 have been described above, an exemplary method of use is provided below. It will be understood that the following description is given as an example and is in no way meant to be limiting. Furthermore, although the following description is given with reference to goal 10, it will be understood that a similar method of use can be employed with any of the other goals 510, 610, 810 and 910 described herein.

Before use, a user may inflate goal 10 using inflation valve 36. This may involve the user blowing into inflation valve 36, or may alternatively be achieved using an air pump or any other suitable method to inflate goal 10. Once goal 10 is inflated, goal 10 is ready for use.

During use, goal 10 may be placed in a pool, lake, pond or other body of water, with lower surface 22 substantially floating on the water. Goal 10 may be used in a game of skill where the object of the game is for the user to throw, kick, skip or otherwise propel an object, such as a ball, through the main aperture, and in some instances at least one secondary aperture, of goal 10. The game may be played by a single user or multiple users.

The vertical or perpendicular orientation of the main aperture allows for the user to propel the object directly through the main aperture, without the need to propel the object in an arcuate path. Furthermore, the arrangement of the main aperture allows for a user to not only propel the object directly through the main aperture, but also allows for the user to skip the object off of the surface of the water, or another surface, through the main aperture, providing an extra skill dynamic to the game.

Once the user is finished using goal 10, goal 10 may be deflated using inflation valve 36. This deflation allows for compaction of goal 10, thereby increasing ease of portability.

Therefore, the various goals 10, 510, 610, 810 and 910 disclosed herein provide a portable water-based game, which tests a user's ability to accurately propel objects directly or by skipping objects off the surface of the water or other surface towards or through a target or goal, which can be used competitively by more than one user, as well as by a single user.

The present invention has been described in terms of one or more preferred embodiments, and it should be appreciated that many equivalents, alternatives, variations, and modifications, aside from those expressly stated, are possible and within the scope of the invention.

I claim:

1. A goal configured to both float and be used on water, the goal comprising:

a base defining a base plane, the base having a longitudinal axis, a continuous non-planar upper surface, and a plurality of longitudinally extending side-by-side tubular members interconnected along their longitudinal sides, including two outermost tubular members, the interconnected tubular members extending parallel to the longitudinal axis;

a support structure having a pair of opposing arm portions coupled to and in fluid communication with the base at the two outermost tubular members, and a curved upper portion coupled to and extending between the pair of opposing arm portions, the support structure being an inverted U-shaped member including the curved upper portion coupled to, extending between, and in fluid communication with, the pair of opposing arm portions; and a planar element coupled to and extending between the pair of opposing arm portions of the support structure, disposed generally perpendicular to the base plane, and defining at least one main aperture, the at least one main aperture being positioned generally concentric with a semicircle defined by the curved upper portion.

2. The goal according to claim 1, wherein each of the base and the inverted U-shaped member are inflatable.

3. The goal according to claim 1, wherein a lower surface of the base is adapted to float on a surface of the water.

4. The goal according to claim 1, wherein the planar element is disposed at an angle other than truly perpendicular to the base plane.

5. The goal according to claim 1, further comprising at least one inflation valve.

6. A goal configured to both float and be used on water, the goal comprising:

a generally rectangular base defining a base plane, the base having a longitudinal axis, a continuous non-planar upper surface, and a plurality of longitudinally extending side-by-side tubular members interconnected along their longitudinal sides, the interconnected tubular members extending parallel to the longitudinal axis;

a support structure having a pair of opposing arm portions coupled to the base and an upper portion coupled to, extending between, and in fluid communication with, the pair of opposing arm portions; and a planar element coupled to and extending between the pair of opposing arm portions of the support structure, disposed generally perpendicular to the base plane, and defining at least one main aperture, the at least one main aperture disposed proximate to the upper portion;

wherein the support structure is disposed such that the planar element is arranged transverse to the longitudinal axis of the base.

7. The goal according to claim 6, wherein the support structure is disposed equidistant from a first longitudinal end and a second longitudinal end of the base.

8. The goal according to claim 6, further comprising at least one tether attachment tab defining a tether aperture, wherein an edge of the tether attachment tab is attached to the base.

9. The goal according to claim 8, wherein the edge of the tether attachment tab is attached to at least one of a latitudinal side and a longitudinal end of the base.

10. The goal according to claim 6, wherein the plurality of tubular members are in fluid communication with one another.

11. The goal according to claim 6, wherein each of the plurality of tubular members have rounded ends.

12. The goal according to claim 1, wherein at least a portion of the planar element is in direct contact with the base.

13. A goal configured to both float and be used on water, the goal comprising:

a base defining a base plane, the base having a longitudinal axis, a continuous non-planar upper surface, and a plurality of longitudinally extending side-by-side tubular members interconnected along their longitudinal sides, the interconnected tubular members extending parallel to the longitudinal axis;

a support structure having a pair of opposing arm portions coupled to the base and a curved upper portion coupled to and extending between the pair of opposing arm portions, the pair of opposing arm portions and curved upper portion being in fluid communication; and a planar element coupled to and extending between the pair of opposing arms of the support structure, disposed generally perpendicular to the base plane, and defining at least one main aperture, the at least one main aperture defined by a radius smaller than a radius of a concave side of the curved upper portion;

wherein the planar element defines a plurality of attachment apertures disposed around a circumference of the at least one main aperture.

14. The goal according to claim 13, wherein a net is attached to the planar element via at least four of the plurality of attachment apertures.

15. The goal according to claim 14, wherein the net defines a substantially cylindrical shape having a pair of open ends and the net is attached to the planar element via one of the pair of open ends.

16. The goal according to claim 14, wherein the net defines a substantially cylindrical shape having an open end and a closed end and the net is attached to the planar element via the open end.

17. The goal according to claim 13, wherein the at least one main aperture is positioned generally concentric with a semicircle defined by the curved upper portion.

* * * * *